US009010996B2

(12) United States Patent
Born et al.

(10) Patent No.: US 9,010,996 B2
(45) Date of Patent: Apr. 21, 2015

(54) DEVICE FOR DETECTING AND SYNCHRONISING THE POSITION OF A WHEEL OF A TIMEPIECE MECHANISM

(71) Applicant: The Swatch Group Research and Development Ltd., Marin (CH)

(72) Inventors: Jean-Jacques Born, Morges (CH); Pierpasquale Tortora, Neuchatel (CH); Cedric Nicolas, Neuchatel (CH); Pascal Lagorgette, Bienne (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 13/762,689

(22) Filed: Feb. 8, 2013

(65) Prior Publication Data

US 2013/0201802 A1 Aug. 8, 2013

(30) Foreign Application Priority Data

Feb. 8, 2012 (EP) ..... 12154504

(51) Int. Cl.
*G04B 18/00* (2006.01)
*G04B 27/00* (2006.01)
(Continued)

(52) U.S. Cl.
CPC ..... *G04B 27/007* (2013.01); *G04C 3/146* (2013.01)

(58) Field of Classification Search
CPC ..... G04C 3/14; G04C 3/146; G04B 27/007
USPC ..... 368/80, 220, 287
See application file for complete search history.

(56) References Cited

U.S. PATENT DOCUMENTS 2,905,777 A * 9/1959 Gayring ..... 200/38 BA
4,504,154 A * 3/1985 Kammerer ..... 368/74
(Continued)

FOREIGN PATENT DOCUMENTS

DE 4311065 C1 * 2/1994
EP 1 413 935 A2 4/2004
(Continued)

OTHER PUBLICATIONS

Phillippe Vez, et al., "Systeme de detection et de synchronisation des aiguilles d'une montre", Societe Suisse de Chronometrie Actes des Congres International de Chronometrie, Sep. 2007, 3 pages.
(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

Device for detecting and synchronising the position of at least one first wheel (16) of a timepiece mechanism (1) for an electronic analogue watch, wherein this first wheel (16) extends in one plane, the detection and synchronisation device (30) comprises at least one light source (32) emitting a light beam (34) and at least one light detection system (36), and this detection and synchronisation device is characterised in that a first light-reflecting element (40) projects from one of the upper or lower surfaces of the first wheel (16) of the timepiece mechanism (1), wherein the light source (32) and the light detection system (36) are arranged so that in a determined position of the first wheel (16) of the timepiece mechanism (1), the light beam (34) emitted by the light source (32) is reflected by the first reflective element (40) in the direction of the light detection system (36).

19 Claims, 2 Drawing Sheets

(51) Int. Cl.

| | |
|---|---|
| ***G04B 19/04*** | (2006.01) |
| ***G04B 19/06*** | (2006.01) |
| ***G04B 19/02*** | (2006.01) |
| ***G04B 37/00*** | (2006.01) |
| ***G04C 3/14*** | (2006.01) |

(56) References Cited

U.S. PATENT DOCUMENTS

| | | | | |
|---|---|---|---|---|
| 5,270,993 | A | 12/1993 | Besson et al. | |
| 5,546,888 | A * | 8/1996 | Skiver et al. | 116/286 |
| 6,307,814 | B1 * | 10/2001 | Farine et al. | 368/80 |
| 7,172,302 | B1 * | 2/2007 | Dittus | 362/28 |
| 2002/0075762 | A1 * | 6/2002 | Peng | 368/47 |
| 2004/0081028 | A1 * | 4/2004 | Yiu | 368/185 |
| 2004/0125702 | A1 | 7/2004 | Kitajima et al. | |
| 2008/0170284 | A1 * | 7/2008 | Hayashi | 359/216 |
| 2010/0296369 | A1 * | 11/2010 | Tortora | 368/69 |

FOREIGN PATENT DOCUMENTS

| | | | |
|---|---|---|---|
| FR | 2 654 227 | A1 | 5/1991 |
| JP | 6-30794 | U | 4/1994 |

OTHER PUBLICATIONS

European Search Report issued Sep. 7, 2012 in corresponding European Application No. 12154504.0 filed Feb. 8, 2012 (with an English Translation).

* cited by examiner

DEVICE FOR DETECTING AND SYNCHRONISING THE POSITION OF A WHEEL OF A TIMEPIECE MECHANISM

This application claims priority from European Patent Application No. 12154504.0 filed Feb. 8, 2012, the entire disclosure of which is incorporated herein by reference.

FIELD OF THE INVENTION

The present invention relates to a device for detecting and synchronising the position of a wheel of a timepiece mechanism for an electronic analogue watch. More specifically, the present invention relates to such a detection and synchronisation device that comprises a light source and a light detection system.

BACKGROUND OF THE INVENTION

Electronic analogue watches are known in which the hour hand and the minute hand for display of the current time are driven either by the same electric motor or by separate electric motors, which cause the wheels of the timepiece mechanism to advance step by step. In both cases it can occur that motor steps are lost because of shocks applied to the watch, the presence of electromagnetic fields or other external interferences. The consequence of this is that, although the internal clock of the watch delivers a correct indication of the current time, the hour and minute hands deliver a distorted indication of this current time, because the motors have jumped several steps under the effect of the external interference applied to the watch. It is therefore necessary to re-synchronise the position of the hour and minute hands either initiated by application software or initiated by the user.

To enable this synchronisation to occur, the watch is equipped with a device for detecting the position of the hour wheel and of the minute wheel. At a predetermined time or when initiated by the user, a control circuit orders the hour wheel and the minute wheel to advance. This control must occur sequentially, i.e. one wheel after the other. During the course of this advancing movement, the hour wheel and the minute wheel each pass through a determined position, in which the device for detecting the position is activated, and this allows the position of the hour and minute wheels to be known with precision. The control circuit then calculates the position of the wheel, compares it to the value supplied by the internal clock of the watch and deducts from these operations the number of motor steps that have to be applied to the hour and minute wheels to bring the hands for displaying the current time to the proper position on the dial of the watch.

A known solution for detecting the position of a wheel of a timepiece mechanism for an electronic analogue watch consists of arranging a light source that emits a light beam and a light detection system on either side of the disc of the wheel. The light source and the light detection system are arranged to face one another and a hole is provided in the disc of the wheel on the path of the light source and the light detection system. When the hole arrives at the level of the light source, the light beam passes through the hole and falls on the light detection system, which allows a precise indication of the position of the wheel to be provided.

Such a device for detecting and synchronising the position of a wheel of a timepiece mechanism for an electronic analogue watch has several disadvantages. The first of these disadvantages lies in the fact that the light source and the light detection system are arranged in tiers in an essentially vertical direction, which makes the detection and synchronisation device bulky and requires spaces to be provided to the top and to the bottom. The second problem critically arises in the case where it is sought to detect the position of two wheels mounted coaxially, as is the case with an hour wheel and a minute wheel. In fact, in such a situation it is necessary, for example, to arrange the two light detection devices between the two wheels and to position the light sources respectively above and below the assembly of the two coaxial wheels. Such an arrangement is not only bulky but additionally requires two of the elements of the detection devices, e.g. the two light detection devices, to be positioned between the wheels, which makes automation of the production of such timepiece movements practically impossible.

SUMMARY OF THE INVENTION

The aim of the present invention is to overcome the aforementioned disadvantages as well as others by providing a device for detecting and synchronising the position of a wheel of a timepiece mechanism for an electronic analogue watch that is in particular less bulky.

On this basis, the present invention relates to a device for detecting and synchronising the position of at least one first wheel of a timepiece mechanism for an electronic analogue watch, wherein this first wheel extends in one plane, the detection and synchronisation device comprises at least one light source emitting a light beam and at least one light detection system, and this detection and synchronisation device is characterised in that a first light-reflecting element projects from one of the upper or lower surfaces of the first wheel of the timepiece mechanism, wherein the light source and the light detection system are arranged so that in a determined position of the first wheel of the timepiece mechanism, the light beam emitted by the light source is reflected by the first reflective element in the direction of the light detection system.

Owing to these features, the present invention provides a detection and synchronisation device, in which the light beam emitted by the light source is reflected by a reflective element, which stands on the surface of a wheel of a timepiece mechanism, in the direction of the light detection system. Instead of being arranged on either side of the wheel, the light source and the detection system can be arranged on the periphery of the wheel, which allows a substantial amount of space to be gained.

According to a complementary feature of the invention, the light source emits a light beam in a direction parallel to the plane in which the wheel of the timepiece mechanism extends.

Instead of falling perpendicularly onto the surface of the wheel, the light beam emitted by the light source is propagated parallel to the plane in which the wheel extends. The light source and the light detection system are thus arranged in the same plane or in a plane parallel to the plane in which the wheel of the timepiece mechanism extends. The detection device according to the invention thus extends horizontally rather than vertically, which allows a substantial reduction in the thickness of the timepiece mechanism and enables the space already existing around the wheel to be utilised to accommodate the required components. The timepiece mechanism can thus be equipped with a detection and synchronisation device according to the invention with unaltered dimensions.

According to a variant of the invention the timepiece mechanism comprises not one, but two wheels mounted coaxially, wherein the second wheel extends in a plane parallel to the plane in which the first wheel extends. Like the first wheel, the second wheel comprises a light-reflecting element, which projects from one of its upper or lower surfaces, wherein this reflective element reflects the light beam emitted by the light source in the direction of the light detection system in a determined position of the second wheel.

As the light source and the light detection system are positioned on the periphery of the assembly of the two coaxially mounted wheels, it is not necessary to position elements of the detection and synchronisation device between these wheels, which allows the production process of the timepiece mechanism to be automated. Moreover, the same light source and the same light detection system can be used alternately to sequentially detect the position of the first and the second wheels, which enables the structure of the detection and synchronisation system according to the invention to be simplified significantly and therefore the reliability to be increased.

BRIEF DESCRIPTION OF THE DRAWINGS

Other features and advantages of the present invention will become clearer from the following detailed description of an exemplary embodiment of the detection device according to the invention, wherein this example is given purely for non-restrictive and illustrative purposes only in association with the attached drawing, wherein.

DETAILED DESCRIPTION OF THE PREFERRED EMBODIMENT

The present invention proceeds from the general inventive idea that consists of equipping a wheel of a timepiece mechanism, the position of which is to be detected, with a reflective element, which stands on a surface of the disc of the wheel and is able to reflect the light beam emitted by a light source arranged on the periphery of the wheel towards a light detection system that is likewise arranged on the periphery of the wheel. Thus, instead of arranging the light source and the light detection system in a tiered manner on either side of the disc of the wheel, which is bulky and increases the thickness of the timepiece mechanism, the space that already exists around the wheel is utilised to accommodate these two components. Consequently, an electronic analogue watch can be equipped with a detection and synchronisation device according to the invention with constant dimensions. Moreover, in the case where one wishes to detect the position of two coaxially mounted wheels, it is not necessary to accommodate some of the components of the detection and synchronisation device between these two wheels, and this means that the thickness of the timepiece mechanism does not have to be increased and that an automated assembly of the timepiece movement is possible. Moreover, a single light source and a single light detection system are sufficient to sequentially detect the position of the two wheels. The structure of the detection and synchronisation system according to the invention is thus significantly simplified and its operation is more reliable.

Figure 1:
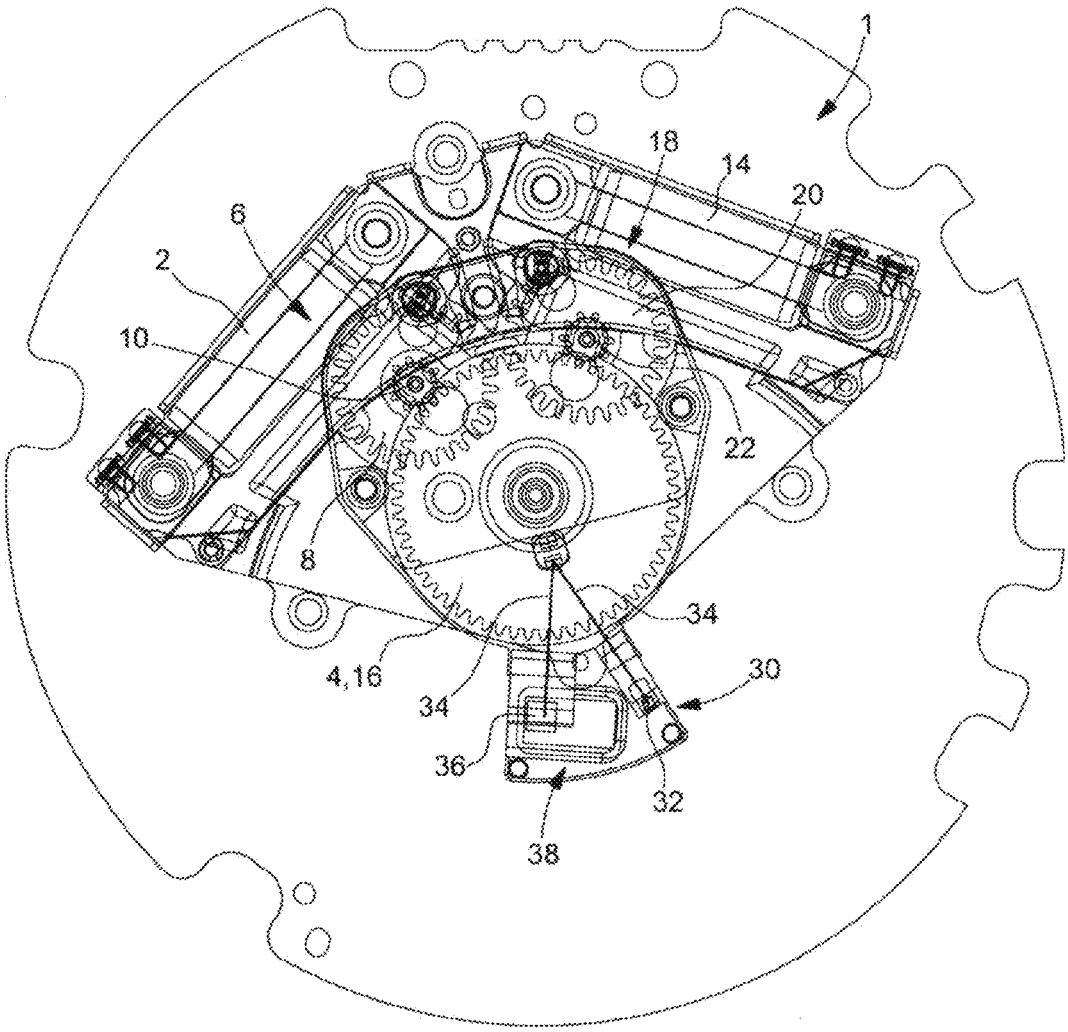
FIG. 1 is a plan view of a timepiece mechanism comprising a device for detecting and synchronising the position of a wheel according to the invention.
Figure 2:
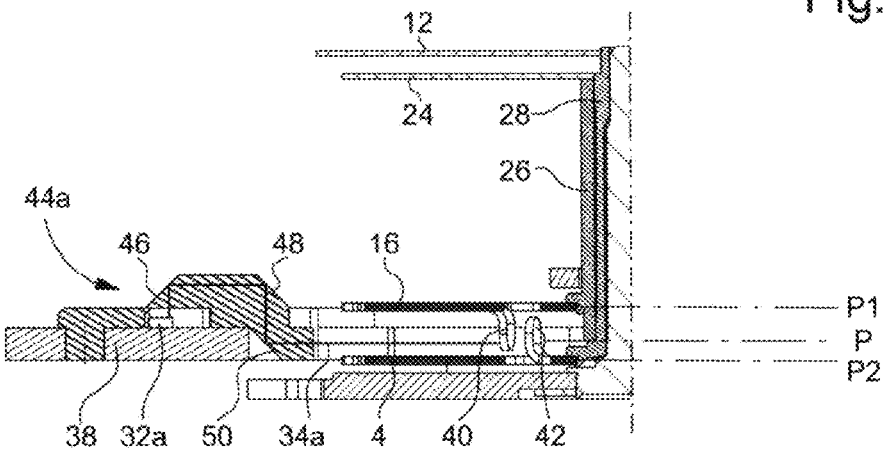
FIG. 2 is a sectional view taken along line A-A of the timepiece mechanism of FIG. 1.

FIG. 1 is a plan view of a timepiece mechanism equipped with a device for detecting and synchronising the position of a wheel according to the invention. FIG. 2 is a sectional view taken along line A-A of the timepiece mechanism of FIG. 1.

Given the overall reference number 1, the timepiece mechanism that is intended to be fitted into an electronic analogue watch comprises a first electric motor 2, which in a manner known per se drives a minute wheel 4 by means of a gear 6 composed of a wheel 8 and a pinion 10. According to an arrangement that is also known per se and will not therefore be described here, the minute wheel 4 is rigidly connected to a minute hand 12. Similarly, the timepiece mechanism 1 comprises a second electric motor 14, which drives an hour wheel 16 by means of a gear 18 composed of a wheel 20 and a pinion 22. The hour wheel 16 is rigidly connected to an hour hand 24. Again in a manner known per se, the hour wheel 16 and the minute wheel 4 are mounted coaxially to be spaced vertically from one another. The hour wheel 16 is mounted on an hour motion work 26 and the minute wheel is mounted on a minute cannon pinion 26 concentric to the hour motion work 26.

The timepiece mechanism 1 also comprises a device 30 for detecting and synchronising the position of the hour wheel 16 and of the minute wheel 4 respectively. According to the invention, this device 30 for detecting and synchronising the position of a wheel comprises a light source 32, which emits a light beam 34 represented by a bold line on the drawing. As will be seen in detail below, the light beam 34 emitted by the light source 32 is sent back in the direction of a light detection system 36 after reflection. Advantageously, the light source 32 and the light detection system 36 are both mounted on the same printed circuit board 38, which also serves as mounting for other components of the timepiece mechanism 1, including the electric motors 2 and 14, amongst others.

In accordance with the invention, the hour wheel 16 and the minute wheel 4 are each fitted with a light-reflecting element, 40 and 42 respectively, which projects from the upper or lower surface of the wheel to which it is connected.

According to a non-restrictive preferred embodiment of the invention the reflective elements 40 and 42 are each provided in the form of a tab that extends essentially 90° in relation to the disc of the wheel. More precisely, the tab or reflective element 40 projects from the inside surface of the hour wheel 16, whereas the tab or reflective element 42 projects from the upper surface of the minute wheel 4.

Still according to the invention, the light source 32 and the light detection system 36 are arranged so that in a well defined position of the hour wheel 16, the light beam 34 is reflected by the tab 40 of the hour wheel 16 in the direction of the light detection system 36. When this event occurs, the position of the hour wheel 16 is known precisely and it is known how many steps the electric motor 14 has to be advanced by to bring the hour hand into the proper position on the dial of the watch by means of the hour wheel 16.

In the same way, the light source 32 and the light detection system 36 are arranged so that, in a well defined position of the minute wheel 4, the light beam 34 is reflected by the tab 42 of the minute wheel 4 in the direction of the light detection system 36. It is then known precisely how many steps the electric motor 2 has to be advanced by to bring the minute hand into the desired position on the dial of the watch by means of the minute wheel 4.

It will be understood that to enable the light beam 34 produced by the light source 32 to be reflected alternately on the tab 40 of the hour wheel 16 and on the tab 42 of the minute hand 4, it is necessary that these two tabs are not arranged in the extension of one another, otherwise one of the tabs would be screened by the other tab at the time of measurement. Therefore, a single light source and a single light detection system are sufficient to sequentially detect the position of the two wheels and their respective hands. The synchronisation of the two hands must be done sequentially, i.e. one hand after the other. For more details on the process of synchronising hands, reference should be made to the proceedings of the 2007 International Congress of Chronometry, pages 107 to 109, published by the Swiss Chronometry Society. The optical detection device according to the invention can be calibrated in a similar manner to the LC oscillator described in this document, the frequency of which varies upon the approach of a metal target. Thus, when the watch is set in operation or during a battery change, the control circuit will initiate a complete rotation for each hand equipped with the optical detection system according to the invention in order to determine the location of the tab on the corresponding wheel by means of the maximum point of reflection of the light by the tab. A complete rotation of the hand round the dial requires 180 motor steps, for example. A measurement of the light intensity detected by the light detection system is performed after each motor step. On passage of the tab of the wheel facing the light detection system, the light intensity reflected by the tab increases abruptly. This abrupt increase in the intensity of the light measured represents the detection of the position of the tab of the wheel. The position corresponding to the abrupt increase in detected light is then stored in the memory. After each measurement, the light intensity value is digitised and transmitted to the control circuit. When the management program of the watch or the user initiates a synchronisation, the control circuit performs N motor steps in anticlockwise direction, starting from the position corresponding to the abrupt increase in intensity of reflected light, without doing any measurement for positioning before the position in which the tab of the wheel faces the light detection system. The control system then performs 2N motor steps with a measurement at each of them. The 2N values thus obtained are stored in the memory. The control circuit then calculates the position of the hand, compares it to the value supplied by its internal clock and corrects this if necessary by initiating reset motor pulses.

On the other hand, it will be noted that the tab or reflective element 40 projects from the lower surface of the hour wheel 16, whereas the tab or reflective element 42 projects from the upper surface of the minute wheel 4 such that the two tabs 40 and 42 extend substantially vertically between the two hour wheel 16 and minute wheel 4, in a median plane P parallel to planes P1 and P2 in which the hour 16 and the minute 4 wheel respectively extend.

It is thus possible thanks to the present invention to detect the position of two wheels 16 and 4 by means of a single detection and synchronisation device 30 comprising a single light source 32 and a single light detection system 36. The detection and synchronisation device 30 according to the invention is therefore more reliable. Moreover, the light source 32 and the light detection system 36 are positioned on the periphery of the wheels 16 and 4, which enables the space already existing around the two wheels 16 and 4 to be utilised to accommodate these two components. The dimensions of the timepiece mechanism 1 equipped with the detection and synchronisation device 30 according to the invention therefore remain unaltered. Moreover, in contrast to the prior art, it is not necessary within the framework of the invention to accommodate components of the detection and synchronisation device 30 between the two wheels 16 and 4. The resulting timepiece mechanism is therefore not as thick and its manufacture can be automated.

According to a first variant of the invention illustrated by FIG. 2, the light source 32 is a known laser diode referred to as a vertical cavity surface emitting laser or VCSEL. By virtue of its design the laser diode 32*a* emits a light beam 34*a* in a direction perpendicular to the median plane P, on either side of which the hour wheel 16 and the minute wheel 4 extend. It is therefore necessary to bring the light beam 34*a* back into a direction parallel to the median plane P in which the reflective elements 40 and 42 extend. For this, an optical device 44*a* is provided that comprises three deflectors 46, 48 and 50, which are arranged at 45° in relation to the propagation direction of the light beam 34*a* and which successively allow the light barn 34*a* to be deflected 90° to bring this light beam 34*a* into the median plane P so that it can be reflected on one or the other of the reflective elements 40 or 42. In addition, the optical device 44*a* is arranged to cause the light beam 34*a* to be deflected in the direction of the reflective elements 40 and 42 and to direct the light reflected by these reflective elements 40 and 42 onto the light detection system 36.

Figure 3:
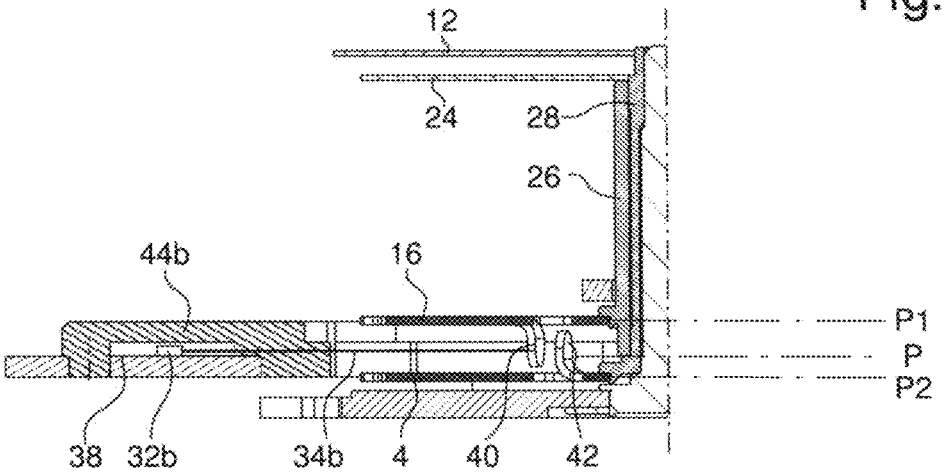
FIG. 3 is a view similar to that of FIG. 2 of a variant of the detection and synchronisation device according to the invention.

According to a second variant of the invention illustrated by FIG. 3, the light source 32 is a light-emitting diode or LED. The advantage of such a light-emitting diode 32*b* is that it can be oriented in order to emit a light beam 34*b* directly in the median plane P or in a direction parallel to this plane. In contrast to a laser diode, a light-emitting diode 32*b* emits a light beam 34*b* that diverges even more. Consequently, an optical device 44*b* is provided that is arranged to cause the light beam 34*b* to converge in the direction of the reflective elements 40 and 42 and to focus the light reflected by these reflective elements 40 and 42 onto the light detection system 36.

It is understood that the present invention is not limited to the embodiments that have just been described and that various simple modifications and variants can be envisaged by a person skilled in the art without departing from the framework of the invention as defined by the attached claims. In particular, it is not necessary for the light source and the light detection system to be arranged in the same plane. In fact, depending on the direction in which the reflective element of the wheel of the timepiece mechanism reflects the light, it is equally possible for the light source and the light detection system to be arranged on the periphery of the wheel in different planes. In the case where the hour wheel 16 and the minute wheel 4 are made of metal, the tabs or reflective elements 40 and 42 can be cut out of the disc of these wheels 16 and 4. In the case where the hour wheel 16 and the minute wheel 4 are made from plastic material, it can be provided that the tabs or reflective elements 40 and 42 are in a single piece with these wheels 4 and 16. It can also be provided that the tabs 40 and 42 are plated to improve their reflectivity of the incident light beam.

According to an interesting variant of the invention the light detection system 36 is a matrix sensor, with which it can be distinguished electronically which of the two wheels 16, 4 is currently being detected. In fact, because of the difference in distance covered by the beam reflected respectively by the tab 40 of the hour wheel 16 and by the tab 42 of the minute hand 4, the light falls on different zones of the matrix sensor. The light detection system 36 can also be a photodetector such as a photodiode.

What is claimed is:

1. A device for detecting and synchronising a position of at least one first wheel of a timepiece mechanism for an electronic analogue watch, wherein this first wheel extends in a plane, the detection and synchronisation device comprises at least one light source emitting a light beam and at least one light detection system, wherein a first light-reflecting element projects perpendicularly from one of an upper or lower surfaces of the first wheel of the timepiece mechanism, wherein the light source and the light detection system are arranged so that in a determined position of the first wheel of the timepiece mechanism, the light beam emitted by the light source is reflected by the first light-reflecting element in the direction of the light detection system, wherein the light source emits a light beam in a direction parallel to the plane in which the first wheel of the timepiece mechanism extends.

2. The detection and synchronisation device according to claim 1, wherein the first light-reflecting element is provided in the form of a tab.

3. The detection and synchronisation device according to claim 2, wherein the tab is bent 90° in relation to the plane in which the first wheel of the timepiece mechanism extends.

4. The detection and synchronisation device according to claim 3, wherein the first wheel is made of metal, and wherein the tab is cut out of a disc of the first wheel.

5. The detection and synchronisation device according to claim 3, wherein the first wheel is made from plastic material, and wherein the tab is in a single piece with the first wheel.

6. The detection and synchronisation device according to claim 5, wherein the tab is plated to improve the tab's reflectivity of the incident light beam.

7. The detection and synchronisation device according to claim 2, wherein the first wheel is made of metal, and wherein the tab is cut out of a disc of the first wheel.

8. The detection and synchronisation device according to claim 2, wherein the first wheel is made from plastic material, and wherein the tab is in a single piece with the first wheel.

9. The detection and synchronisation device according to claim 8, wherein the tab is plated to improve the tab's reflectivity of the incident light beam.

10. The detection and synchronisation device according to claim 1, wherein the light source is a light-emitting diode.

11. The detection and synchronisation device according to claim 10, wherein the detection and synchronisation device comprises an optical device, which is arranged to cause the light beam emitted by the light-emitting diode to converge in the direction of the first reflective element and to focus the light reflected by the first reflective element onto the light detection system.

12. The detection and synchronisation device according to claim 1, wherein the light source is a vertical cavity surface emitting laser or VCSEL type laser diode.

13. The detection and synchronisation device according to claim 12, wherein the laser diode emits a light beam in a direction perpendicular to the plane in which the first wheel extends, and wherein the detection and synchronisation device comprises an optical device, which is arranged to cause the light beam to be deflected in a direction parallel to the plane in which the first wheel of the timepiece mechanism extends, and to direct the light beam in the direction of the first reflective element.

14. The detection and synchronisation device according to claim 1, wherein a second wheel of the timepiece mechanism is mounted coaxially on the first wheel, wherein the second wheel extends in a plane parallel to the plane in which the first wheel extends, wherein the second wheel comprises a second light-reflecting element which projects from one of an upper or lower surfaces of the second wheel, and wherein in a determined position of the second wheel, the second reflective element reflects the light beam emitted by the light source in the direction of the light detection system.

15. The detection and synchronisation device according to claim 14, wherein the first wheel of the timepiece mechanism bears an hour hand, wherein the second wheel bears a minute hand, and wherein the hour hand and the minute hand are driven by a same electric motor or by two separate electric motors.

16. The detection and synchronisation device according to claim 1, wherein the light detection system is a matrix sensor or a photodiode.

17. A timepiece mechanism for an electronic analogue watch, comprising:

a first wheel extending in a first plane; and a light source configured to emit a light beam parallel to said first plane, a first light-reflecting element mounted to said first wheel and projecting at a perpendicular angle from said first plane, said first light-reflecting element being positioned to reflect said light beam parallel to said first plane; and a light detection system configured to detect, in a determined position of said first wheel, said light beam from said light source and reflected from said first light-reflecting element.

18. The timepiece mechanism according to claim 17, comprising:

a second wheel extending in a second plane parallel to said first plane; and a second light-reflecting element mounted to said second wheel and projecting at a non-zero angle from said second plane, said second light-reflecting element being positioned to reflect said light beam from said light source parallel to said second plane, wherein said light detection system is configured to detect, in determined positions of said first and second wheels, said light beam from said light source and reflected from said first and second light-reflecting elements.

19. The timepiece mechanism according to claim 18, further comprising a control circuit configured to synchronize said first and second wheels based on detection from said light detection system for said determined positions.

* * * * *